US006523450B1

(12) United States Patent
Schreiber

(10) Patent No.: US 6,523,450 B1
(45) Date of Patent: Feb. 25, 2003

(54) EXTERIOR ARMOR FOR USE ON BOTTOM OF HELICOPTER

(76) Inventor: Arthur Schreiber, 1814 W. 135th St., Gardena, CA (US) 90249

( * ) Notice: Subject to any disclaimer, the term of this patent is extended or adjusted under 35 U.S.C. 154(b) by 0 days.

(21) Appl. No.: 09/956,633

(22) Filed: Sep. 20, 2001

Related U.S. Application Data

(60) Provisional application No. 60/233,905, filed on Sep. 20, 2000, now abandoned.

(51) Int. Cl.[7] ..... F41H 5/04; F41H 7/00

(52) U.S. Cl. ..... 89/36.11; 89/36.02; 244/121

(58) Field of Search ..... 89/36.11, 36.02; 244/121; 109/49.5

(56) References Cited

U.S. PATENT DOCUMENTS 4,352,851 A 10/1982 Heitz et al.
5,007,326 A * 4/1991 Gooch, Jr. et al. ..... 89/36.02
5,542,626 A * 8/1996 Beuck et al. ..... 244/107
5,747,721 A 5/1998 Speakes et al.
5,970,843 A 10/1999 Strasser et al.

FOREIGN PATENT DOCUMENTS

FR 475429 * 5/1915 ..... 89/36.11
GB 555700 * 9/1943 ..... 89/36.11

* cited by examiner

*Primary Examiner*—Stephen M. Johnson

(57) ABSTRACT

A bullet proof armor plate fabricated of layered ceramic material is mounted on the outer bottom wall of a helicopter in spaced relationship to such wall. A frame is used to support the armor plate, this frame being removably attached to mounts supported on the bottom wall of the helicopter at points where there are existing apertures. The front end of the support frame for the armor plate is aero-dynamically configured to minimize drag.

5 Claims, 2 Drawing Sheets

EXTERIOR ARMOR FOR USE ON BOTTOM OF HELICOPTER

This application is based on provisional application No. 60/233,905 filed Sep. 20, 2000 now abandoned and enjoys the priority of that application.

BACKGROUND OF THE INVENTION

1. Field of the Invention

This invention relates to helicopters and more particularly to exterior armor for shielding the bottom of a helicopter against ground fire.

2. Description of the Related Art

Protection is needed on the bottom of helicopters against ground fire from small arms. As the fuselage of helicopters need be light, the bottom portion is generally vulnerable to small arms fire from the ground which puts the occupants at hazard. The use of bullet proof armor for the bottoms of helicopters has been suggested in the past, as, for example, in the second paragraph of the "Background" discussion of U.S. Pat. No. 5,970,843 issued Oct. 26, 1999 to Strasser, et al. There is no description in this reference, however, as to how such armor is to be installed and whether it would be on the interior or the exterior of the helicopter.

Certain Russian helicopters have been constructed with armor along the interior floor thereof. Such interior installations have the disadvantage of being difficult to install and remove in view of the structure along the floor of the helicopter as well as the helicopter seats which have to be removed each time the armor is installed and removed. U.S. Pat. No. 5,747,721 issued May 5, 1998 to Speaks, et al. describes a ballistic shield which is configured to the shape of the aircraft and is mounted opposite such fuselage (the bottom of a helicopter is suggested) with a space between the fuselage and the shield. The shield is constructed so that it has hollow compartments with ballistic inserts installed therein. There is no suggestion in this patent of a support frame such as in Applicant's device, which can readily be installed and removed on and from the base of a helicopter and by means of which a unitary armor shield is supported.

BRIEF SUMMARY OF THE INVENTION

The device of the present invention overcomes the aforementioned shortcomings of the prior art in providing a bullet proof armor plate made of layered ceramic material which is mounted on the outer bottom wall of a helicopter in spaced opposing relationship to such wall. A frame is used to support the armor plate, this frame being removably attached to mounts supported on the bottom wall at points where there are existing apertures. The front end of the support frame for the armor plate is aerodynamically configured to minimize drag.

It is therefore an object of this invention to provide an improved shield for a helicopter against ground fire;

It is a further object of this invention to provide an improved helicopter shield which can more easily be installed and removed;

Other objects of the invention will become apparent from the following description taken in connection with the accompanying drawings.

DETAILED DESCRIPTION OF THE INVENTION

Figure 1:
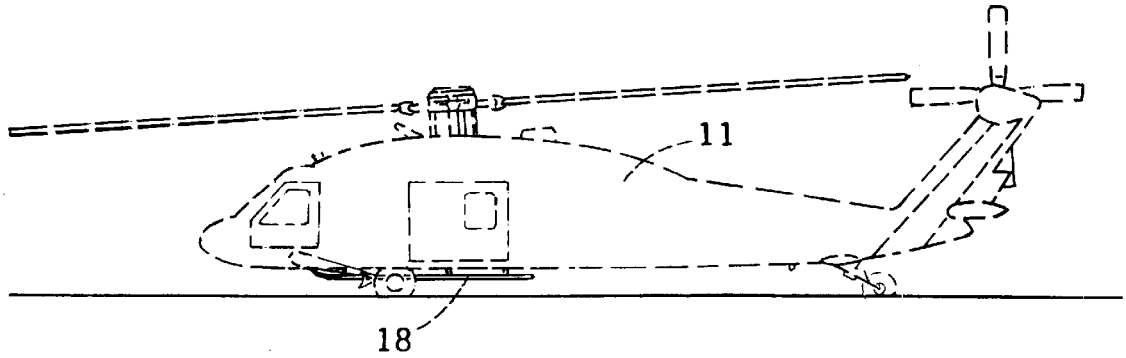
FIG. 1 is side elevational view of a preferred embodiment of the device of the invention installed on a helicopter.
Figure 2:
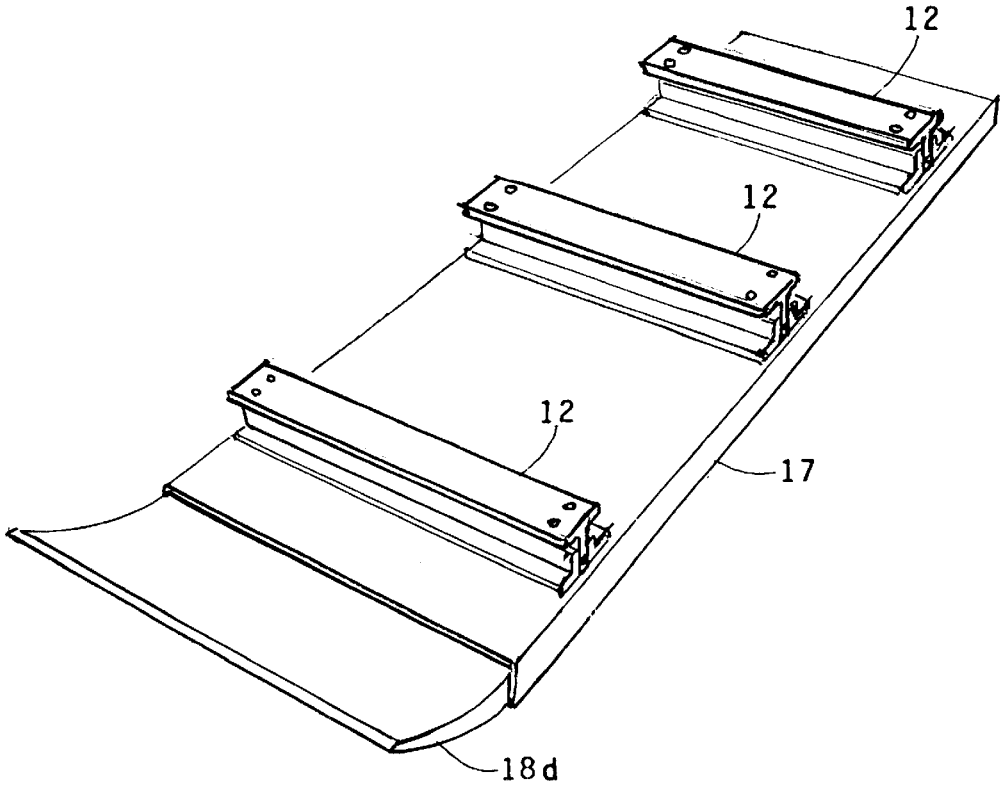
FIG. 2 is a top perspective view of the frame utilized in the device of the invention with the armor plate installed therein.
Figure 3:
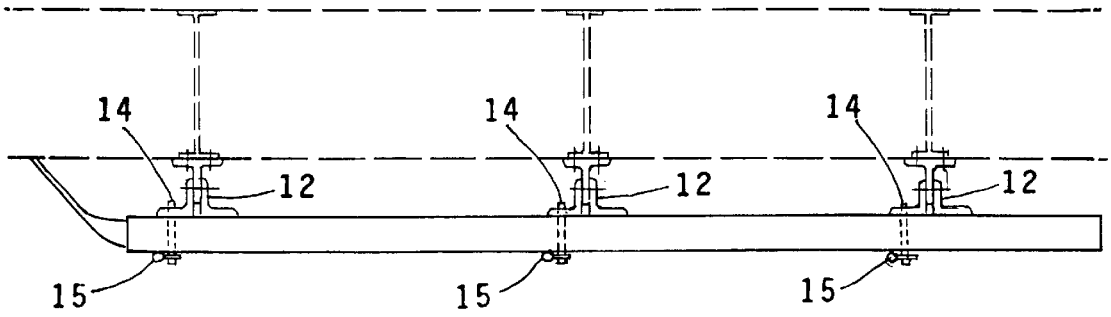
FIG. 3 is a side elevational view showing the device of the invention installed in a helicopter.

Referring to FIGS. 1–4, a preferred embodiment of the invention is illustrated.

Protruding from the base of helicopter 11 are a plurality of mounts 12. These mounts are attached to the base where existing apertures already exist. Frame 17 (see FIG. 2) is attached to mounts 12 by means of screws 14 and wing nuts 15. Armor plate 18 (See FIG. 2) is fixedly mounted in frame 17.

Typically the separation between the armor plate and the base of the helicopter is about 2 inches and the thickness of plate 18 us about ¾". The separation of the armor plate from the base of the helicopter avoids damage to the helicopter base when the armor is struck by bullets since the inner wall of the armor tends to buckle. The forward end 18*d* of the armor plate is aerodynamically formed to minimize drag.

Figure 4:
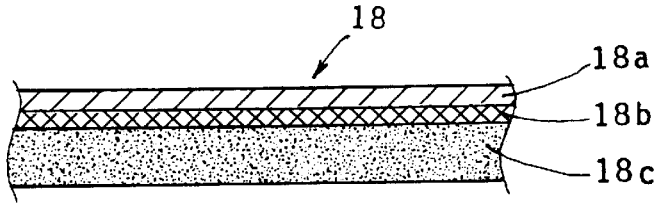
FIG. 4 is a cross-sectional view illustrating the structure of the armor which may be used in the device of the invention.

Referring to FIG. 4, a typical structure for the armor plate 18 is illustrated. The plate has an inner layer 18*a* of a ceramic material such as alumina oxide or silicon carbide; a middle layer 18*b* which may be of aramid polyamide (Dupont Kevlar); and an outer layer 18*c* which may be polyurethane(Allied Chemical Spectra). The plate is about ¾" thick with layers 18*a* and 18*b* being about ⅛" in thickness and layer 18*c* about ½" thick.

In view of the spacing between the armor shield and the base of the helicopter, the shield structure also provides cushioning in the event of a forced landing.

While the invention has been described and illustrated in detail, it is to be clearly understood that this is intended by way of example only, and is not to be taken by way of limitation , the scope of the invention being limited only by the terms of the following claims:

I claim:

1. A shield mounted on the outer bottom wall of a helicopter for protection against ground fire comprising:

a bullet proof armor plate;

at least three mounts supported on the outer bottom wall of said helicopter, said mounts each comprising a pair of opposing plates separated from each other by a third plate normal to said opposing plates and running between the opposite ends of said opposing plates; and a frame removably attached to said mounts, a portion of said frame being spaced from said outer bottom wall of said helicopter;

said mounts being spaced from each other along the length of said frame and running normal to the longitudinal axis of said frame with one of said mounts being proximate to the center of the frame and the other of said mounts each being located proximate to a separate end portion of the frame;

said armor plate being attached to said spaced portion of said frame such that said plate is spaced from said bottom wall of said helicopter.

2. The shield of claim 1 wherein said mounts are supported on said bottom wall at locations where preexisting apertures are formed in said bottom wall.

3. The shield of claim 1 wherein said armor plate is formed from an inner layer of ceramic, a center layer of aramid polyamide, and an outer layer of polyurethane.

4. The shield of claim 3 wherein the thickness of said armor plate is about ¾".

5. The shield of claim 1 wherein the forward end of the armor plate is aerodynamically formed to minimize drag.

* * * * *